United States Patent [19]

Takizawa et al.

[11] Patent Number: 5,013,625

[45] Date of Patent: May 7, 1991

[54] PHOTORECEPTOR

[75] Inventors: Yoshio Takizawa; Kunio Sigeta; Shigeki Takeuchi; Hiroshi Yoshioka; Yoshihide Fujimaki, all of Hachioji, Japan

[73] Assignee: Konica Corporation, Tokyo, Japan

[21] Appl. No.: 478,569

[22] Filed: Feb. 12, 1990

[30] Foreign Application Priority Data

Feb. 13, 1989 [JP] Japan ..... 1-34240

[51] Int. Cl.[5] ..... G03G 15/04

[52] U.S. Cl. ..... 430/64; 430/60

[58] Field of Search ..... 430/60, 64

[56] References Cited

U.S. PATENT DOCUMENTS 4,190,445 2/1980 Takahashi et al. ..... 430/66

4,621,014 11/1986 Lu ..... 428/216

4,895,781 1/1990 Takai ..... 430/58

FOREIGN PATENT DOCUMENTS 2611719 10/1976 Fed. Rep. of Germany ..... 430/60

*Primary Examiner*—Marion E. McCamish

*Assistant Examiner*—S. C. Crossan

*Attorney, Agent, or Firm*—Finnegan, Henderson, Farabow, Garrett, and Dunner

[57] ABSTRACT

A photoreceptor that has at least a subbing layer and a light-sensitive layer formed on an electro-conductive supports is disclosed. The improvement is that said subbing layer is formed of a copolymer comprising ethylene, vinyl acetate and an unsaturated carboxylic acid and/or vinyl alcohol.

5 Claims, 3 Drawing Sheets

PHOTORECEPTOR

BACKGROUND OF THE INVENTION

The present invention relates to a photoreceptor, in particular, an electrophotographic photoreceptor.

In electrophotographic copying by the Carlson process, an electric charge layer is deposited on the surface of a photoreceptor and after exposure to form a latent electrostatic image, it is developed by a toner and the resulting visible image is transferred and fixed to a receiving sheet such as paper. Subsequently, the toner is removed from the surface of the photoreceptor and any residual charges are neutralized to erase the electrostatic image completely and condition the photoreceptor for another cycle, thereby enabling its cyclic use for a prolonged period.

For successful operation of electrophotography, the photoreceptor must satisfy various requirements not only in terms of electrophotographic characteristics such as good chargeability and sensitivity plus small dark decay but also in terms of physical properties such as long run length and high resistance to wear and moisture during cyclic use, as well as in terms of resistance to environmental conditions such as ozone generated upon corona discharging and ultraviolet radiation emitted during exposure.

Electrophotographic photoreceptors that have been commonly used in the art are inorganic products having a photosensitive layer that is based on inorganic photoconductive materials such as selenium, zinc oxide and cadmium sulfide. The use of various organic photoconductive materials as the effective component of light-sensitive layers in electrophotographic photoreceptors has been the subject of active research and development efforts in the recent years. However, the photoreceptors developed so far along this line were not completely satisfactory in terms of sensitivity and durability. In order to overcome this problem, attempts have been made to develop an organic photoreceptor of high sensitivity and durability by composing the light-sensitive layer of two different materials, one being responsible for carrier generation and the other for carrier transport. Electrophotographic photoreceptors of this "functionally separated type" provide for a great latitude in the selection of appropriate materials that exhibit the intended functions, and this enables photoreceptors having desired characteristics to be prepared fairly easily. FIG. 6 shows an electrophotographic photoreceptor of a "functionally separated type" that employs an organic photoconductive material. As shown, it is composed of an electroconductive support 1 which is successively coated with a carrier generation layer 6 and a carrier transport layer 4. The carrier generation layer 6 and the carrier transport layer 4 combine to make a light-sensitive layer 8 which is to be negatively charged. When charged negatively, the photoreceptor shown in FIG. 6 has a greater hole mobility than electron mobility and this permits the use of hole transporting materials having good characteristics, which is a definite advantage in such aspects as photosensitivity. On the other hand, there is high likelihood that carriers (holes) are injected unevenly from the conductive support, eventually causing microscopic loss or decrease of surface charges. In reversal development, this leads to the formation of image defects as black spots (i.e., black blobs) and the quality of the image obtained will deteriorate significantly. The problem of black blobs is a phenomenon unique to photoreceptors that employ organic photoconductors having high hole mobility and this is believed to have been caused by uneven injection of carriers. Thus, it has been proposed that a subbing layer be provided between the conductive support and the light-sensitive layer to block the injection of carriers as shown in FIG. 1. The subbing layer which is indicated by 7 in FIG. 1 can be formed of various materials and known examples are resins such as polyesters, polyvinyl butyral, polyvinyl formal, polyvinyl acetate, polyvinyl chloride, polyvinyl phenol and cellulose. However, the known subbing layers are not highly effective in preventing the occurrence of black blobs. further, none of the resin systems used today in subbing layers are capable of providing a blocking capability while insuring the production of highly sensitive photoreceptors. Those which have a sufficient blocking capability to prevent the occurrence of black blobs are ineffective in producing sensitive photoreceptors. On the other hand, photoreceptors having high sensitivity cannot be produced without failure to achieve satisfactory prevention of black blobs due to insufficient blocking of carrier injection.

Under these circumstances, a technique of incorporating electron releasing materials in ethylene copolymer resins has been proposed in JP-A-60-218658 (the term "JP-A" as used herein means an "unexamined published Japanese patent application"). According to this technique, an electron releasing material is incorporated in a subbing layer to form carrier traps, which are effective to some extent in blocking the injection of carriers from the electroconductive support. However, the carrier traps in the subbing layer will increase the residual potential during cyclic use of the fabricated protoreceptor. Further, the photoreceptor does not have high sensitivity.

If ordinary ethylene copolymers are used to form a subbing layer, difficulty is frequently encountered in subsequent coating of a carrier generation layer (i.e., it will not effectively wet with the as-applied subbing layer or any uneveness in the coating of a subbing layer is prone to be reproduced in a subsequently coated carrier generation layer) or it often occurs that the subbing layer does not adhere strongly to the carrier generation layer.

Semiconductor lasers which are inexpensive, small in size and which are capable of direct modulation have recently gained popularity as light sources to be used in electrophotographic processes. Gallium-aluminum-arsenic (Ga-Al-As) lightemitting devices that are used extensively as semiconductor lasers have oscillating wavelengths longer than about 750 nm. The use of laser beams is anticipated to be applicable to printers but as a matter of fact, photoreceptors having high sensitivity to light in the longer wavelength range have not yet been developed.

SUMMARY OF THE INVENTION

An object, therefore, of the present invention is to provide a photoreceptor that is capable of forming image without defects such as black blobs and that has satisfactory sensitivity to light having comparative long wavelengths such as one emitted from semiconductor lasers.

Another object of the present invention is to provide photoreceptor that has long run length, high stability in potential and good residual potential characteristic.

Still another object of the present invention is to provide photoreceptor that has a subbing layer, a carrier generation layer and a carrier transport layer formed successively on an electroconductive support and in which the carrier generation layer is coated uniformly and has strong adhesion to the subbing layer.

These objects of the present invention can be attained by a photoreceptor that has at least a subbing layer and a light-sensitive layer formed on an electroconductive support and in which said subbing layer is formed of a copolymer comprising ethylene, vinyl acetate and an unsaturated carboxylic acid and/or vinyl alcohol.

BRIEF DESCRIPTION OF THE DRAWINGS

FIG. 1 is a partial sectional view of a photoreceptor according to an embodiment of the present invention;

FIG. 2 is a schematic view of an image forming apparatus;

FIG. 3 is a flow chart of image forming process;

FIG. 4 is a partial sectional view of a photoreceptor according to another embodiment of the present invention;

FIG. 5 is a partial sectional view of a photoreceptor according to still another embodiment of the present invention; and FIG. 6 is a partial sectional view of a prior art electrophotographic photoreceptor.

DETAILED DESCRIPTION OF THE INVENTION

It is very important for the purposes of the present invention that the subbing layer provided on an electroconductive support be formed of a copolymer of ethylene, vinyl acetate and an unsaturated carboxylic acid and/or vinyl alcohol. As already mentioned, uneven injection of holes from the support is highly likely to occur when organic photoconductive materials having high hole mobility are used in light-sensitive layers, but the copolymer used in the present invention has a blocking capability that effectively prevents this phenomenon. This blocking capability of the copolymer is enhanced by the fact the copolymer has sufficiently good adhesion to a substrate to be form a uniform subbing layer. A particular advantage of this polymer is that it can be coated to form a desired subbing layer without producing crystals and that the resin in the subbing layer will not dissolve out when an overlying layer is applied. Hence, it is anticipated that the subbing layer formed of this copolymer provides a barrier against local injection of carriers from the support, to thereby prevent the loss or decrease of surface charges due to local carrier injection. A significant advantage that results from this fact is that reversal development can be performed to produce image without black blobs and that the image obtained has high quality without any other defects such as white blobs, rough surface or pinholes.

If the subbing layer in the photoreceptor of the present invention is solely composed of a homopolymer of ethylenic hydrocarbons, it will not have satisfactory solubilizability or good adhesion to a substrate. In fact, the subbing layer is formed of a copolymer comprising ethylene, vinyl acetate and an unsaturated carboxylic acid and/or vinyl alcohol and hence has good adhesion to a substrate.

An unsaturated carboxylic acid and/or vinyl alcohol are components that are copolymerized with ethylene and vinyl acetate in the subbing layer in the photoreceptor of the present invention and illustrative unsaturated carboxylic acids include acrylic acid, methacrylic acid, maleic acid and maleic anhydride.

The ethylene component of the copolymer is preferably contained in an amount of at least 40 wt%, and the vinyl acetate component is preferably contained in an amount of 1–50 wt%.

The copolymer desirably has a melt flow rate (MFR) of 1–50 g/10 min.

The following resins are specific examples of the ethylene copolymer of which the subbing layer in the photoreceptor of the present invention is formed:

A. ethylene/vinyl acetate/unsaturated carboxylic acid copolymer exemplified by Elbaks 4260, 4355, 4320 and 4310, all being available from Mitsui-DuPont Chemical Co., Ltd.; and B. ethylene/vinyl acetate/vinyl alcohol copolymer exemplified by Dumiran D-219, 229 and 251S, all being available from Takeda Chemical Industries, Inc.

The subbing layer is preferably not thicker than 1 μm in order to insure that its blocking performance is fully exhibited while providing the photoreceptor with satisfactory performance such as resistance to increase in residual potential.

The photoreceptor of the present invention typically has the structure shown in FIG. 1. This photoreceptor comprises an electroconductive support (substrate) 1 that has a subbing layer 7 formed of a copolymer of ethylene, vinyl acetate, and an unsaturated carboxylic acid and/or vinyl alcohol, which is overlaid with a carrier generation layer 6 which in turn is overlaid with a carrier transport layer 4. The carrier generation layer 6 and the carrier transport layer 4 combine to make a light-sensitive layer 8. The subbing layer 7 provided between the carrier generation layer 6 and the support 1 effectively prevents holes from being unevenly injected from the support as in the case shown in FIG. 6. At the same time, the subbing layer 7 insures efficient transport of photocarriers (i.e., electrons) to the support under illumination with light.

The structure of the photoreceptor of the present invention is by no means limited to that shown in FIG. 1 (i.e., the carrier generation layer is overlaid with the carrier transport layer) and the light-sensitive layer 8 may be a single layer containing a carrier generation material and a carrier transport material in admixture as shown in FIG. 4. In another embodiment, the carrier transport layer 4 may be overlaid with the carrier generation layer 6 as shown in FIG. 5 to form a structure that is to be positively charged.

For extending the run length and for attaining other purposes, a protective layer or film may be formed on the surface of the photoreceptor of the present invention by, for example, coating a synthetic resin film.

Organic pigments may be used as carrier generation materials in the photoreceptor of the present invention and typical examples of such organic pigments are mentioned below:

(1) azo pigments such as monoazo pigments, bisazo pigments, triazo pigments and metal complex salts of azo pigments;

(2) perylene pigments such as perylene anhydride and perylene acid imide;

(3) polycyclic quinone pigments such as anthraquinone derivatives, anthanthrone derivatives, dibenzpyrene quinone derivatives, pyranthrone derivatives, violanthrone derivatives and isoviolanthrone derivatives;

(4) indigoid pigments such as indigo derivatives and thioindigo derivatives; and (5) phthalocyanine pigments such as metalophthalocyanines and metal-free phthalocyanines.

Among these organic pigments, phthalocyanine pigments have high sensitivity in the longer wavelength region and hence are suitable for use in photoreceptors to be illuminated with semiconductor lasers. Illustrative metalo-phthalocyanines include those having copper as the center atom (see, for example, JP-B-52-1667 the term "JP-B" as used herein means an "examined Japanese patent publication") and JP-A-55-60958 and JP-A-57-20741, and those which have aluminum, titanium, vanadium, indium, etc. as the center atom (see, for example, JP-A-53-89433, JP-A-57-148745, JP-A-63-218768 and Japanese Patent Application No. 62-173640), and oxytitanium phthalocyanines (type Y, type $\beta$ and type A) are preferred from the viewpoint of high sensitivity. Illustrative metal-free phthalocyanines include $\chi$-type metal-free phthalocyanine (JP-B-49-4338), $\tau$-type metal-free phthalocyanine (JP-A-58-182639), and $\alpha$-, $\beta$- and $\epsilon$-type phthalocyanines, with $\tau$-type phthalocyanine being preferred from the viewpoint of sensitivity and stability in potential.

Azopigments described in JP-A-58-194035 and Japanese Patent Application No. 62-336384 are also used preferably as carrier generation materials and bisazo compounds represented by the following general formula (F) are particularly preferred:

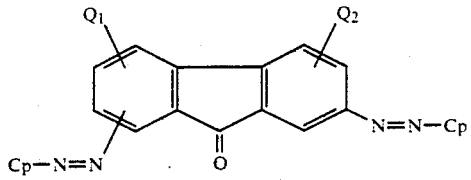

(F)

where Q1 and Q2 each represents a hydrogen atom, a halogen atom, an alkyl group, an alkoxy group, a cyano group or a trifluoromethyl group. Illustrative halogen atoms include chlorine, bromine and iodine atoms; illustrative alkyl groups include methyl, ethyl, butyl and alkoxy groups; and illustrative alkoxy groups include methoxy, elthoxy and butoxy groups. A hydrogen atom and ahalogen atom are particularly preferred.

Cp in the general formula (F) represents a coupler residue and preferred coupler residues are those which are represented by the following structural formulas (1) to (11):

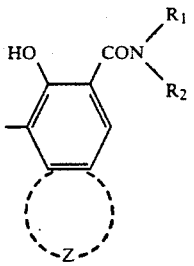

(1)

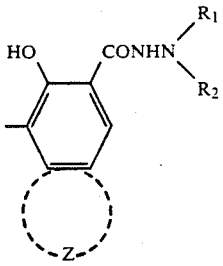

(2)

-continued

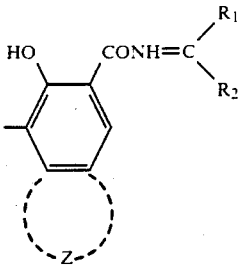

(3)

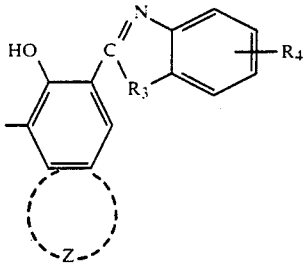

(4)

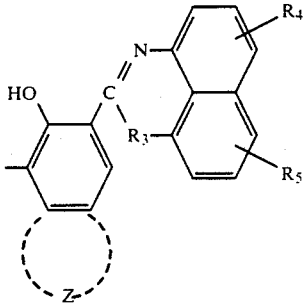

(5)

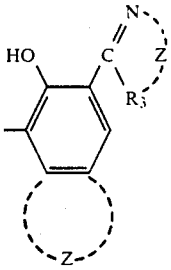

(6)

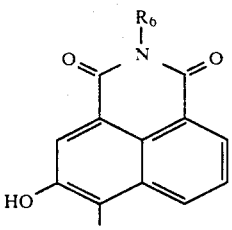

(7)

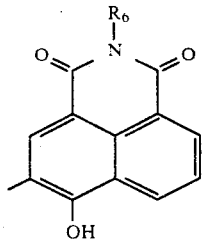

(8)

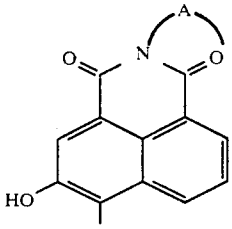

(9)

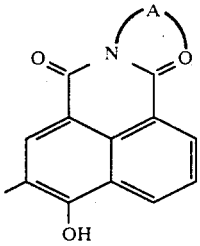

(10)

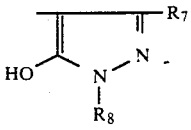

(11)

wherein Z represents the atomic group which is necessary to form a polycyclic aromatic or heterocyclic group by condensing with a benzene ring; $R_1$ and $R_2$ each represents a hydrogen atom or an optionally substituted alkyl, aralkyl aryl or heterocyclic group, and $R_1$ and/or $R_2$ may form a ring together with the nitrogen or carbon atom; $R_3$ is O, S or —NH; $R_4$ and $R_5$ each represents a hydrogen atom, an alkyl group, an alkoxy group, a nitro group, a cyano group, a halogen atom or an acetyl group; A is a divalent group in a carbocyclic aromatic ring or a heterocyclic aromatic ring; $R_6$ is an optionally substituted alkyl, aralkyl, aryl or heterocyclic group; $R_7$ is a hydrogen atom, an alkyl group, a dialkylamino group, a diarylamino group, a dialkylamino group, a carbamoyl group, a carboxyl group or an ester group thereof; and $R_8$ is an aromatic cyclic group or a substituted form thereof.

Among the coupler residues described above, those which are represented by structural formulas (1), (3), (9) and (10) are preferred and those which are represented by the following structural formulas (1-a) and (1-b) are particularly preferred:

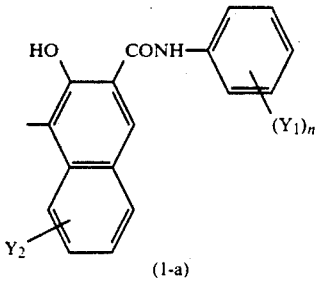

(1-a)

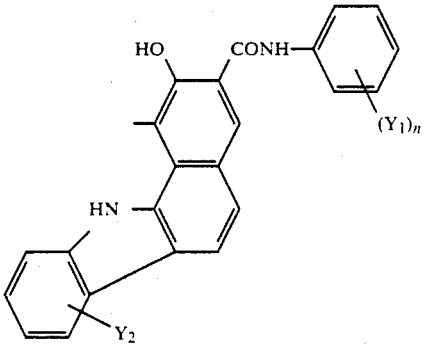

(1-b)

where $Y_1$ and $Y_2$ each represents a hydrogen atom, a halogen atom, an alkyl group, an alkoxy group, a nitro group, a cyano group or a trifluoromethyl group.

Polyeyelic quinone pigmetns described in JP-A-55-126254 are other pigments that are preferably used in the present invention and examples of such polycyclic quinone pigments are represented by the following general formulae (Q1), (Q2) and (Q3):

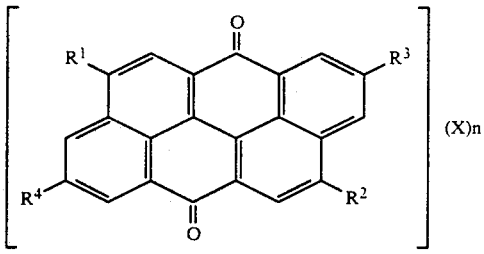

(Q1)

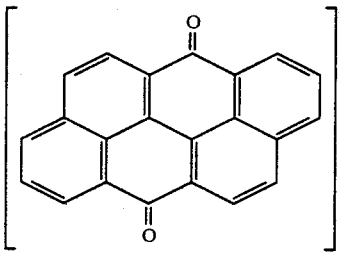

(Q2)

-continued

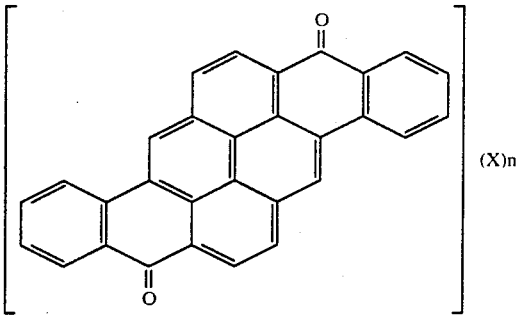

(Q3)

where $R_1$, $R_2$, $R_3$ and $R_4$ are each a halogen atom, X is a halogen atom or a group $NO_2$, CN or $COOCH_3$, and n is an integer of 0–4.

The ratio of the content of the carrier generation material to that of the binder material in the carrier generation layer is preferably in the range of from 5:1 to 1:10, with the range of 3:1 to 1:3 being more preferred. If the ratio is greater than 5:1, the chance of the appearance of black blobs and other image defects will increase. If, on the other hand, the content of the carrier generation material is very small, the photosensitivity and other electrophotographic characteristics of the finally obtained photoreceptor will deteriorate.

The carrier generation layer preferably has a thickness of at least 0.1 pm, with the range of 0.2–5 μm being more preferred.

The carrier transport layer preferably has a thickness of at least 10 μm.

The total thickness of the light-sensitive layer is preferably within the range of from 10 to 40 μm, with the range of 15–30 μm being more preferred. If the total thickness of the light-sensitive layer is smaller than 10 μm, the charging potential and the run of the photoreceptor tend to decrease. If the total thickness of the light-sensitive layer exceeds 40 μm, the residual potential will increase. Further, phenomena will take place that are similar to those which occur in an excessively thick carrier generation layer and there is high likelihood that desired transport capability is not insured. This contributes to a greater chance of elevation in the residual potential during cyclic use.

A carrier transport material can also be incorporated in the carrier generation layer.

If a particulate carrier generation material is to be dispersed to form a light-sensitive layer, it is preferably in the form of a powder having an average particle size of no more than 2 μm, preferably no more than 1 μm, with 0.5 μm or below being more preferred.

The carrier generation material to be incorporated in the carrier generation layer preferably has good miscibility with the binder material. This enables the carrier generation material to be incorporated in a great amount compared to the binder material without causing turbidity or opacity, to thereby insure that the two materials can be mixed in various proportions over a very wide range. The good miscibility of the carrier generation material with the binder material also contributed to the formation of a uniform and stable carrier generation layer, and a consequent improvement in sensitivity and charging characteristics, which eventually results in a photoreceptor that is capable of forming a high-sensitivity and sharp image. A further advantage is that the resulting photoreceptor can be employed in transfer electrophotography without experiencing deterioration due to fatigue in cyclic use.

In the present invention, the carrier generation materials described above may be used in combination with one or more of other carrier generation materials, such as anthraquinone pigments, perylene pigments, squaric acid methine pigments, cyanine pigments and azulenium compounds.

Carrier transport materials that can be used in the present invention are selected from among carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzothiazole derivatives, benzimidazole derivatives, quinazoline derivatives, benzofuran derivatives, acridine derivatives, phenazine derivatives, aminostilbene derivatives, triarylamine derivatives, phenylene-diamine derivatives, stilbene derivatives, poly-N-vinylcarbazole, polyl-1-vinylpyrene poly-9-vinylantharacene etc., which compounds may be used either individually or in admixtures.

Specific examples of the compounds that can be used as carrier transport materials are described in JP-A-63-50851, as summarized below.

Styryl compounds having the following general formulas (VII) and (VIII) are useful as carrier transport materials:

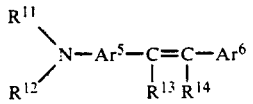

(VII)

where $R_{11}$ and $R_{12}$: a substituted or unsubstituted alkyl or an aryl group, with a suitable substituent being an alkyl group, an alkoxy group, a substituted amino group, a hydroxyl group, a halogen atom or an aryl group;

$Ar^5$ and $Ar^6$: a substituted or unsubstituted aryl group, with a suitable substituent being an alkyl group, an alkoxy group, a substituted amino group, a hydroxyl group, a halogen atom or an aryl group;

$R^{13}$ and $R^{14}$: a substituted or unsubstituted aryl group or a hydrogen atom, with a suitable substituent being an alkyl group, an alkoxy group, a substituted amino group, a hydroxyl group, a halogen atom or an aryl group;

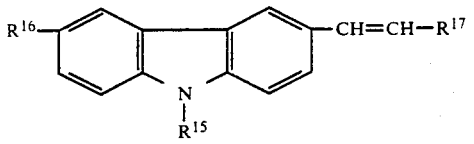

(VIII)

where $R^{15}$: a substituted or unsubstituted aryl group;

$R^{16}$: a hydrogen atom, a halogen atom, a substituted or unsubstituted alkyl group, an alkoxy group, an amino group, a substituted amino group or a hydroxyl group;

$R^{17}$: a substituted or unsubstituted aryl group, or a substituted or unsubstituted heterocyclic group.

Hydrazone compounds having the following general formulas (IX), (X), (Xa), (Xb) and (XI) can also be used as carrier transport materials:

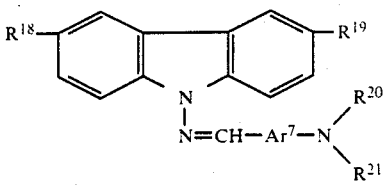

(IX)

where $R^{18}$ and $R^{19}$: a hydrogen atom or a halogen atom;

$R^{20}$ and $R^{21}$: a substituted or unsubstituted aryl group;

$Ar^7$: a substituted or unsubstituted arylene group;

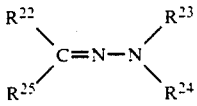

(X)

where $R^{22}$ a substituted or unsubstituted aryl group, a substituted or unsubstituted carbazolyl group, or a substituted or unsubstituted heterocyclic group;

$R^{23}$, $R^{24}$ and $R^{25}$ a hydrogen atom, an alkyl group, a substituted or unsubstituted aryl group, or a substituted or unsubstituted aralkyl group;

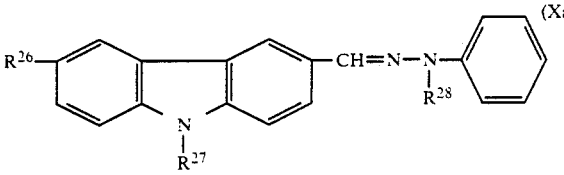

(Xa)

where $R^{26}$: a methyl group, an ethyl group, a 2-hydroxyethyl group or a 2-chloroethyl group;

$R^{27}$: a methyl group, an ethyl group, a benzyl group or a phenyl group;

$R^{28}$: a methyl group, an ethyl group, a benzyl group or a phenyl group;

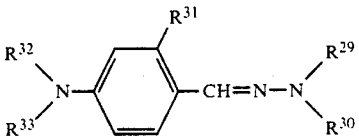

(Xb)

where $R^{29}$ a substituted or unsubstituted naphtyyl group;

$R^{30}$: a substituted or unsubstituted alkyl group;

$R^{31}$: a hydrogen atom, an aralkyl group or an alkoxy group;

$R^{32}$ and $R^{33}$: groups which may be the same or different and which are selected from a substituted or unsubstituted alkyl group, an aralkyl group and an aryl group;

(XI)

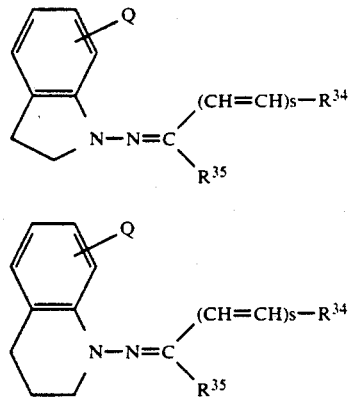

where $R^{34}$: a substituted or unsubstituted aryl group or a substituted or unsubstituted heterocyclic group;

$R^{35}$: a hydrogen atom, a substituted or unsubstituted aralkyl group, or a substituted or unsubstituted aryl group;

Q: a hydrogen atom, a halogen atom, an alkyl group, a substituted amino group, an alkoxy group or a cyano group;

s: an integer of 0 or 1.

Pyrazoline compounds of the following general formula (XII) can also be used as carrier transport materials (XII)

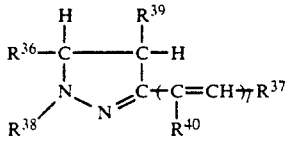

where l: 0 or 1;

$R^{36}$ and $R^{37}$: a substituted or unsubstituted aryl group;

$R^{38}$: a substituted or unsubstituted aryl group or hetarocyclic group;

$R^{39}$ and $R^{40}$: a hydrogen atom, an alkyl group of 1–4 carbon atoms, or a substituted or unsubstituted aryl or aralkyl group, provided that $R^{39}$ and $R^{40}$ are not both a hydrogen atom, and that when l is 0, $R^{39}$ is not a hydrogen atom.

Amine derivatives of the following general formula (XIII) are also useful as carrier transport materials:

(XIII)

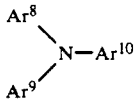

where $Ar^8$ and $Ar^9$: a substituted or unsubstituted phenyl group, with a suitable substituent being a halogen atom, an alkyl group, a nitro group or an alkoxy group;

$Ar^{10}$: a substituted or unsubstituted phenyl group, a naphthyl group, an anthryl group, a fluorenyl group or a heterocyclic group, with a suitable substituent being an alkyl group, an alkoxy group, a halogen atom, a hydroxyl group, an aryloxy group, an aryl group, an amino group, a nitro group, a piperidino group, a morpholino group, a naphthyl group, an anthryl group or a substituted amino group, the last-mentioned amino group being substituted by an acyl group, an alkyl group, an aryl group or an aralkyl group.

Compounds of the following general formula (XIV) are also useful as carrier transport materials:

(XIV)

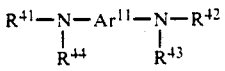

where $AR^{11}$: a substituted or unsubstituted arylene group;

$R^{41}$, $R^{42}$, $R^{43}$ and $R^{44}$ a substituted or unsubstituted alkyl group, a substituted or unsubstituted aryl group, or a substituted or unsubstituted aralkyl group.

Compounds of the following general formula (XV) are also usable as carrier transport materials:

(XV)

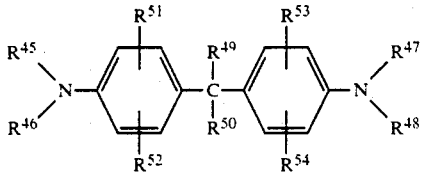

where $R^{45}$, $R^{46}$, $R^{47}$ and $R^{48}$ each represents a hydrogen atom, a substituted or unsubstituted alkyl group, a cycloalkyl group, an alkenyl group, an aryl group, a benzyl group or an aralkyl group; $R^{49}$ and $R^{50}$ each represents a hydrogen atom, a substituted or unsubstituted alkyl group having 1–40 carbon atoms, a cycloalkyl group, an alkenyl group, a cycloalkenyl group, an aryl group or an aralkyl group, provided that $R^{49}$ and $R^{50}$ may combine to form a saturated or unsaturated hydrocarbon ring having 3–10 carbon atoms; $R^{51}$, $R^{52}$, $R^{53}$ and $R^{54}$ each represents a hydrogen atom, a halogen atom, a hydroxyl group, a substituted or unsubstituted alkyl group, a cycloalkyl group, an alkenyl group, an aryl group, an aralkyl group, an alkoxy group, an amino group, an alkylamino group or an arylamino group.

An antioxidant may be incorporated in the carrier transport and generation layers. This is effective in safeguarding against the effects of ozone generation by discharging, to thereby prevent the increase in residual potential or decrease in charging potential during cyclic use. Exemplary antioxidants include hindered phenol, hindered amine, paraphenylenediamine, arylalkanes, hydroquinone, spirochroman, spiroindanone, derivatives thereof, organic sulfur compounds and organic phosphorus compounds. Specific compounds that can be used as antioxidants are described in JP-A-63-14153, JP-AP-63-18355, JP-A-63-44662, JP-A-63-50848, JP-A-63-50849, JP-A-63-58455, JP-A-63-71856, JP-A-63-71857 and JP-A-63-146046.

High-molecular weight organic semiconductors may also be incorporated in the light-sensitive layer. Poly-N-vinylcarbazole and its derivatives are particularly effective high-molecular weight semi-conductors and are preferably used. Poly-N-vinyl-carbazole derivatives are such that all or part of the carbazole rings in the recurring units have various substituents selected from among, for example, an alkyl group, a nitro group, an amino group, a hydroxyl group and a halogen atom. At least one electron acceptor may be contained in the light-sensitive layer for various purposes such as sensitivity improvement and reduction in residual potential or fatigue due to cyclic use. Exemplary electron acceptors that can be used in the photoreceptor of the present invention are listed below: succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-paranitrobenzonitrile, dinitrobenzene, m-dinitrobenzene, 1,3,5-trinitrobenzene, paranitrobenzonitrile, picryl chloride, quinonechloroimide, chloranil, bromanil, 2-methylnaphthoquinone, dichlorodicyanoparabenzoquinone, anthraquinone, dinitroanthraquinone, trinitrofluorenone, 9-fluorenylidene (dicyanomethylenemalonodinitrile), polynitro-9-fluorenylidene-(dicyanomethylenemalonodinitrile), picric acid, o-nitrobenzoic acid, p-nitrobenzoic acid, 3,5-dinitrobenzoic acid, pentafluorobenzoic acid, 5-nitro salicylic acid, 3,5-dinitrosalicylic acid, phthalic acid, mellitic acid, and other compounds having high electron affinity. These electron acceptors may be used either individually or as admixtures. Among the compounds listed above, fluorenone compounds, quinone compounds and benzene derivatives having electron-withdrawing groups such as Cl, CN and $NO_2$ are particularly preferred.

Silicone oil and fluorine-containing surfactants may also be incorporated as surface modifiers in the light-sensitive layer. Ammonium compounds may be incorporated as durability improving agents. If desired, ultraviolet (uv) absorbers may also be used. Preferred uv absorbers include benzoic acid, stilbene compounds and derivatives thereof, and nitrogenous compounds such as triazole compounds, imidazole compounds, triazine compounds, coumarin compounds, oxadiazole compounds, thiazole compounds, and derivatives thereof.

Exemplary binder resins that may be used in constituent layers of the photoreceptor include: addition polymerization type resins, polyaddition type resins and polycondensation type resins such as polyethylene, polypropylene, acrylic resins, methacrylic resins, vinyl chloride resins, vinyl acetate resins, epoxy resins, polyurethane resins, polyester resins, epoxy resins, polyurethane resins, polyester resins, alkyd resins, polycarbonate resins, melamine resins, polyvinylidene chloride and polystyrene; copolymer resins containing at least two of the recurring units described above; insulator resins such as vinyl chloride/vinyl acetate copolymer resin; styrene/butadiene copolymer resin and vinylidene chloride/acrylonitrile copolymer resin; high-molecular weight organic semiconductors such as N-vinylcarbazole; and modified silicone resins. These binders may be used either alone or as admixtures.

Binders in an optionally provided protective layer may be selected from transparent resins that have a volume resistivity of at least $10^8$ ohms.cm, preferably at least $10^{10}$ ohms.cm, more preferably at least $10^{13}$ ohms.cm.

Resins that cure upon exposure to light or heat may also be used as binders, and examples of such photo- or heat-curable resins include heat-curable acrylic acids, epoxy resins, urethane resins, urea resins, polyester resins, alkyd resins, melamine resins, photocurable cinnamic resins, as well as copolymerization or condensation resins thereof. All other photo- or heat-curable resins that are conventionally used in electrophotographic materials may be employed.

An optionally provided protective layer may contain less than 50 wt% of a thermoplastic resin as required to attain such purposes as improving processability and physical properties (e.g. resistance to cracking and provision of flexibility). Examples of useful thermoplastic resins include polypropylene, acrylic resins, methacrylic resins, vinyl chloride resin, vinyl acetate resin, epoxy resin, polycarbonate resins, copolymerization resins thereof, high-molecular weight semiconductors such as poly-N-vinylcarbazole, and any other thermoplastic resins that are conventionally used in electrophotographic materials.

The carrier generation layer may be provided by either one of the following methods:

(A) a binder and a solvent are added to a carrier generation material and any necessary ingredient and the solution formed by subsequent mixing is applied; or (B) a carrier generation material and any necessary ingredient are placed in a dispersion medium and treated with such a device as a ball mill, a homo-mixer, a sand mill, an ultrasonic disperser or an attritor to form fine particles, which are mixed with a binder to form a dispersion, followed by application of said dispersion.

In either method, a uniform dispersion can be obtained by dispersing particles under the action of ultrasonic waves.

The carrier transport layer may be formed by a process which comprises dissolving or dispersing the already described carrier transport material either alone or together with the already described binder resin, coating the resulting solution or dispersion, and drying the applied coating.

If a carrier transport material is to be incorporated in the carrier generation layer, methods (A) and (B) may be modified in such a way that the carrier transport material is preliminarily dissolved in the solution to be prepared in method (A), or in the dispersion to be prepared in method (B). In this case, the carrier transport material is preferably added in an amount of 1-100 parts by weight per 100 parts by weight of the binder. Another method that can be adopted comprises the following steps: preparing a solution containing the carrier transport material, applying the solution onto the carrier generation layer, and allowing the carrier generation layer to swell or partly dissolve so that the carrier transport material diffuses into the carrier generation layer. If this method is adopted, there is no need to add a carrier transport material before the carrier generation is formed but this preliminary addition of a carrier transport material may be combined with the second method.

Illustrative solvents or dispersion media that may be used in forming constituent layers of the photoreceptor include: n-butylamine, diethylamine, ethylenediamine, isopropanolamine, triethanolamine, triethylenediamine, N,N-dimethylformamide, acetone, methyl ethyl ketone, cyclohexanone, benzene, toluene, xylene, chloroform, 1,2-dichloroethane, dichloromethane, tetrahydrofuran, dioxane, methanol, ethanol, isopropanol, ethyl acetate butyl acetate and dimethyl sulfoxide.

The light-sensitive layer, subbing layer, protective layer and any other constituent layers in the photoreceptor of the present invention may be formed by various methods such as blade coating, dip coating, spray coating, roll coating, and spiral coating.

The electroconductive support may be a metal plate, a metal or a substrate such as paper or a plastic film having an electroconductive thin layer formed by such method as coating, evaporation or lamination, which conductive thin layer is made of a conductive polymer, conductive compound such as indium oxide, or a metal such as aluminum, palladium or gold.

A recording apparatus that employs the photoreceptor of the present invention is shown in FIG. 2. A flowchart of reversal development that is performed in an electrophotographic process is shown in FIG. 3. The apparatus shown in FIG. 2 comprises the following components: a photoreceptor 23 in drum form that rotates in a direction indicated by the arrow and which has a light-sensitive layer 8 and a subbing layer 7, which light-sensitive layer contains one of the organic photoconductive materials described herein; a charging device 22 that deposits a uniform electric charge layer on the surface of photoreceptor 23; a developing device 15; a pre-exposure lamp 20 that may be optionally provided to facilitate transfer of a toner image from photoreceptor 23 onto a recording medium P; a transfer device 21; a separating corona discharger 19; a fixing device 12 for fixing the toner image on recording medium P; an erasing device 13 that is composed of either an erasure lamp or an erasing corona charger or both; and a cleaning unit 14 having a cleaning blade or a fur brush that is used to remove residual toner particles from the surface of photoreceptor 23 after image transfer. Exposing light is indicated by 24 in FIG. 2.

When imagewise exposure is to be performed with a semiconductor laser, exposing light 24 in preferably one that is emitted from a laser beam scanner if the photoreceptor 23 is drum-shaped as in the case shown in FIG. 2. If the recording apparatus is of such a type that permits the use of a photoreceptor in belt or other flat forms, imagewise exposure may be performed by flash exposure.

Using the recording apparatus described above, an electrophotographic process may be carried out in accordance with the procedure outlined in FIG. 3. The flowchart of FIG. 3 shows an example of reversal development that forms an electrostatic image by an electrostatic image forming method in which the imagewise exposed area is held at a lower potential than the background and in which development is accomplished by depositing toner particles on the electrostatic image that are charged for the same polarity as the potential at the background. The process starts with preconditioning the photoreceptor 23 by neutralizing any residual charges with eraser 13 and removing the remaining toner image with cleaning unit 14 to reduce the surface potential of the photoreceptor to zero volts. On the surface of this photoreceptor in the initial state, a uniform charge layer is deposited by means of charging device 22 and the charged surface is flooded with exposing light 24 to perform imagewise exposure until the potential in the electrostatic image is substantially zero volts. The resulting electrostatic image is rendered visible by processing with developing device 15 (toner particle T is deposited). The image forming method described above may be implemented with various kinds of light sources including a halogen lamp, a tungsten lamp, LED (light-emitting diode), gas lasers such as He—Ne, Ar, and He—Cd lasers, and semiconductor lasers.

The photoreceptor of the present invention can be used to form image with many various types of image forming apparatus such as electro-photographic copiers, printers, etc.

The following example is provided for the purpose of further illustrating the present invention but is in no way to be taken as limiting. Various other modifications are of course included within the scope of the present invention.

Photoreceptor sample Nos. 1–8 of the present invention and comparative sample Nos. 1–8 were prepared by the following procedure. First, the resins shown below were added to toluene (for their concentrations, see Tables 1 and 2) and dissolved completely by heating at 50° C. to prepare coating solutions for subbing layer.

(1) Elbaks 4260 (Mitsui-DuPont Chemical Co., Ltd.) Ethylene/vinyl acetate/methacrylic acid copolymer with vinyl acetate content of 28 wt% and MFR of 6 g/10 min;

(2) Dumilan D-251S (Takeda Chemical Industries, Ltd.) Ethylene/vinyl acetate/vinyl alcohol copolymer with MFR of 14 g/10 min;

(3) Comparative resin (see Table 2).

Aluminum cylinders having a diameter of 80 mm, a length of 355 mm and a wall thickness of 1 mm and which had been finished to have a specular surface were dip-coated with the solutions by first submerging them in these solutions and then pulling them up at a speed (coating speed) of 300 mm/min. The applied coatings were dried at 40° C. for 30 min to form subbing layers in a thickness of 0.5 μm. The coating solutions for subbing layer had been subjected to filtration with a filter having a pore size of 0.6 pm.

Forty grams of a phthalocyanine compound (for its name, see Table 1 and 2) as a carrier generation material (CGM) was added to 2,000 ml of a solution having 200 g of a silicone resin "KR-5240" (product of Shin-Etsu Chemical Co., Ltd.; solids content, 20%) dissolved in methyl ethyl ketone. By subsequent dispersion with a sand grinder for 4 h, a coating solution for carrier generation layer was prepared.

As for bisazo pigments, a 15-g portion was added to 1,000 ml of a solution having 5 g of a butyral resin "ES-lec BH-3" (product of Sekisui Chemical Co., Ltd.) dissolved in methyl ethyl ketone. By subsequent dispersion with a ball mill for 12 h, a coating solution was prepared.

The cylinders having subbing layers formed on their surface were dip-coated with the solutions by first submerging them in these solutions and then pulling them up at a speed of 720 mm/min. The applied coatings were dried to form carrier generation layers (CGL) in a thickness of 0.5 μm.

Two hundered grams of a carrier transport material (CTM) (for its name, see Tables 1 and 2) and 400 g of a polycarbonate resin "Jupilon Z-200" (Product of Mitsubishi Gas Chemical Co., Inc.) were dissolved in 2,000 ml of 1,2-dichloroethane. The cylinders each having a subbing layers and a carrier generation layer formed on their surface were dip-coated with the solutions by first submerging them in these solutions and then pulling them up at a speed (coating speed) of 90 mm/min. The applied coatings were dried at 85° C. for 1 h to form carrier transport layers (CTL) in a thickness of 20 μm.

Each of the thus fabricated 16 photoreceptor samples was set in an electrophotographic copier adapted from "U-Bix 1550" (product of Konica Corp.) equipped with a semiconductor laser. The grid voltage was adjusted in such a way that $V_H$ would be $-700\pm10$ volts. With the potential on the exposure plane held at $V_L$ under illumination with light at an energy of 0.7 mW, reversal development was conducted at a bias of $-600$ volts. After taking 5000 copies, the values of $V_H(-V_H^{5000})$ and $V_L(-V_L^{5000})$ were measured. At the same time, the resistance of each sample against the appearance of black blobs in the white background of copied image was evaluated by counting the number of black blobs (≧0.05 mmΦ) per square centimeter with an image analyzer Model OMNICON 300 of Shimazu Corp. The results were evaluated by the following

| Number of black blobs larger than 0.05 mmΦ | Rating |
|---|---|
| $0/cm^2$ | ◎ |
| $1-3/cm^2$ | ○ |
| $4-10/cm^2$ | Δ |
| $11/cm^2$ | x |

Samples rated ◎ and ○ were acceptable for practical purposes but those rated Δ would sometimes be unacceptable whereas those rated x were entirely unacceptable.

In order to examine the resistance of subbing layers against solvent, the applied and dried subbing layers were immersed in methyl ethyl ketone which was a solvent for, the formation of carrier generation layer. Thereafter, the subbing layers were observed under a scanning electron microscope (SEM). Those samples having the subbing layer left uniformly in the submerged area were rated ◎, and those which had non-uniform subbing layers or dissolved or cracked subbing layers were rated Δ or x.

The adhesion between subbing and light-sensitive layers was evaluated by a grid pattern test which was conducted in the following manner. Using a cutter guide having slits spaced apart by 1 mm, eleven parallel grooves were cut through the coatings into the electroconductive support in two crossed directions to form a grid pattern of 100 squares cut into the coatings. An adhesive tape 24 mm wide was applied over the cross-hatched area and quickly pulled off at one end. The number of squares that were left intact in the cross-hatched area was counted. Samples that had no square pulled off were evaluated to have strong adhesion whereas samples that had all squares pulled off were evaluated as poor.

The results of evaluations conducted on sample Nos. 1-8 of the present invention are shown in Table 1, whereas those of evaluations conducted on comparative sample Nos. 1-8 are shown in Table 2. As is clear from Table 1, subbing layers formed in accordance with the present invention were effective in fabricating photoreceptors that were free from black blobs (indicating the uniformity or homogeneity of subbing layers) and which yet retained good electrophotographic characteristics in such aspects as charging potential, sensitivity and stability of potential during cyclic use. However, in the absence of subbing layers as in comparative sample Nos. 1 and 2, many black blobs occurred. Comparative sample Nos. 3 and 4 had subbing layers but since they were made of a resin outside the scope of the present invention, the solvent resistance of their subbing layers was insufficient to prevent black blobs. Comparative sample Nos. 5 and 6 had homogeneous blocking layers that effectively prevented the occurrence of black blobs. However, they were poor in stability of potential and adhesion to the substrate. Comparative sample Nos. 7 and 8 were unacceptable not only in adhesion to the substrate but also in stability of potential and resistance to the appearance of black blobs.

TABLE 1

| Sample No. | Subbing layer: Resin: Trade name | Subbing layer: Resin: Manufacturer | Subbing layer: Concentration (wt/vol %) | Subbing layer: Resistance to CGL solvent (under observation with SEM) | Subbing layer: Uniformity of CGL (as visually inspected) | Material in light-sensitive layer: CGM* | Material in light-sensitive layer: CTM** | Electrophotographic characteristics: $-V_H$ (V) | Electrophotographic characteristics: $-V_L$ (V) | Electrophotographic characteristics: $-V_H^{5(00)}$ (V) | Electrophotographic characteristics: $-V_L^{5(00)}$ (V) | Black blob | Adhesion between subbing layer and CGL (grid pattern test) |
|---|---|---|---|---|---|---|---|---|---|---|---|---|---|
| 1 | Elbaks 4260 | Mitsui-Dupont Chemical Co., Ltd. | 3 | ◎ | ◎ | I | B | 685 | 60 | 678 | 72 | ◎ | 100/100 |
| 2 | " | Mitsui-DuPont Chemical Co., Ltd. | 3 | ◎ | ◎ | II | B | 680 | 68 | 655 | 76 | ◎ | 100/100 |
| 3 | " | Mitsui-DuPont Chemical Co., Ltd. | 3 | ◎ | ◎ | III | B | 689 | 43 | 660 | 58 | ◎ | 100/100 |
| 4 | " | Mitsui-DuPont Chemical Co., Ltd. | 3 | ◎ | ◎ | I | A | 701 | 75 | 689 | 87 | ○ | 100/100 |
| 5 | " | Mitsui-DuPont Chemical Co., Ltd. | 3 | ◎ | ◎ | IV | B | 675 | 78 | 660 | 88 | ○ | 100/100 |
| 6 | Dumilan D-251S | Takeda Chemical Industries, Ltd. | 4 | ◎ | ◎ | I | B | 690 | 71 | 685 | 85 | ○ | 90/100 |
| 7 | " | Takeda Chemical Industries, Ltd. | 4 | ◎ | ◎ | II | A | 689 | 78 | 690 | 92 | ○ | 90/100 |
| 8 | " | Takeda Chemical Industries, Ltd. | 4 | ◎ | ◎ | III | B | 685 | 57 | 680 | 65 | ○ | 90/100 |

*GCM:
I τ-type metal-free phtbalocyanine
II X-type metal-free phthalocyanine
III Y-type oxytitanium phthalocyanine (see Japanese Patent Application No. 62-173640)
IV bisazo pigment

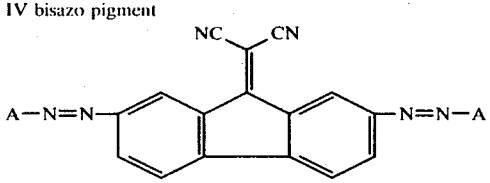

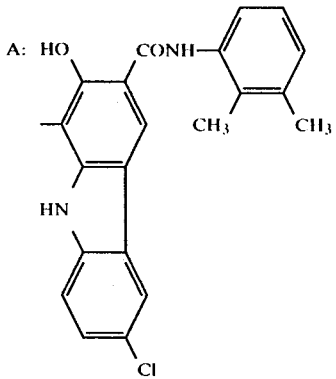

**CTM:

TABLE 1-continued
| | |
|---|---|
| (A) 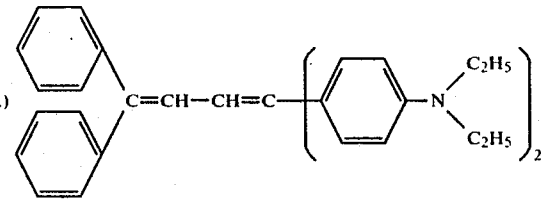 | (B) 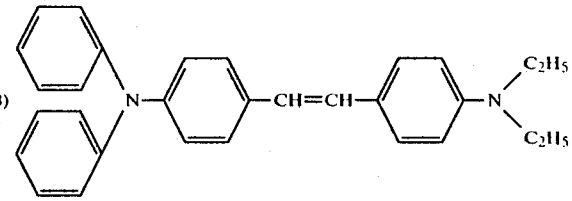 |

TABLE 2

| Comparative Sample No.* | Subbing layer: Resin Composition | Resin Trade name | Resin Manufacturer | Concentration (wt/vol %) | Resistance to CGL solvent (under observation with SEM) | Uniformity of CGL (as visually inspected) | Material in light-sensitive layer CGM** | Material in light-sensitive layer CTM*** | Electrophotographic characteristics $-V_H$ (V) | $-V_L$ (V) | $-V_H^{5000}$ (V) | $-V_L^{5000}$ (V) | Black blob | Adhesion between subbing layer and CGL (grid pattern test) |
|---|---|---|---|---|---|---|---|---|---|---|---|---|---|---|
| 1 | — | — | — | — | — | ◎ | I | B | 690 | 91 | 675 | 110 | X | — |
| 2 | — | — | — | — | — | ◎ | III | B | 685 | 85 | 680 | 115 | X | — |
| 3 | polyvinyl butyral | ES-lec Bn-S | Sekisui Chemical Co., Ltd. | 3 | X | Δ | I | B | 659 | 70 | 685 | 92 | X | 100/100 |
| 4 | polyvinyl butyral | ES-lec BM-S | Sekisui Chemical Co., Ltd. | 3 | X | Δ | III | A | 655 | 65 | 689 | 88 | X | 100/100 |
| 5 | ethylene/acrylic acid | Zaiksen A | Seitetsu Kagaku Co., Ltd. | 3 | Δ | Δ | I | B | 695 | 68 | 672 | 120 | O | 20/100 |
| 6 | ethylene/acrylic acid | Zaiksen A | Seitetsu Kagaku Co., Ltd. | 3 | Δ | Δ | IV | C | 680 | 90 | 665 | 145 | O | 20/100 |
| 7 | ethylene/vinyl chloride/vinyl acetate | Sumika-flex 810 | Sumitomo Chemical Co., Ltd. | — | Δ | Δ | I | A | 685 | 78 | 670 | 105 | Δ | Stripped off |
| 8 | ethylene/vinyl chloride/vinyl acetate | Sumika-flex 810 | Sumitomo Chemical Co., Ltd. | — | Δ | Δ | III | B | 685 | 68 | 672 | 110 | Δ | Stripped off |

*No subbing layer in Comparative sample Nos. 1 and 2. Subbing layer was formed of polyvinyl butyral in Comparative Sample Nos. 3 and 4.
Comparative Sample Nos. 5 and 6 contained 100 ppm of anthraquinene in subbing layer and used a solvent system of methanol and water.
Subbing layer was formed from a diluted aquenous emulsion in Comparative Sample Nos. 7 and 8.
**CGM:
I τ-type metal-free phtalocyanine
II X-type metal-free phthalocyanine
III Y-type oxytitanium phthalocyanine (see Japanese Patent Application No. 62-173640)
IV ε-type copper pothalocyarine
***CTM:

(A)
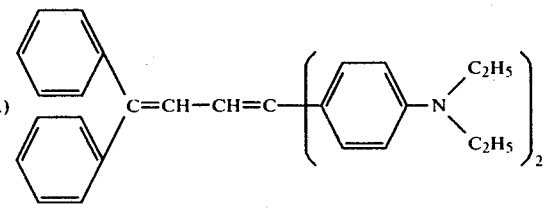

(B)
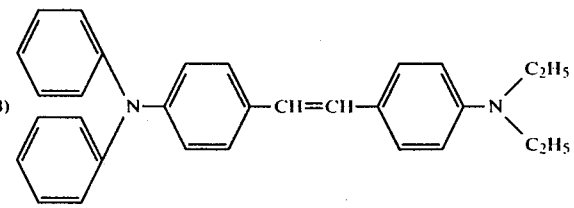

(C)
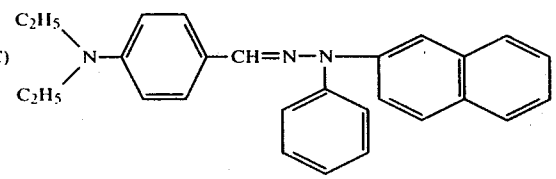

What is claimed is:

1. A photoreceptor having an electro-conductive support, a subbing layer and a light-sensitive layer provided thereon, wherein said subbing layer is arranged between said support and said light-sensitive layer and said subbing layer is formed of a copolymer comprising ethylene, vinyl acetate and an unsaturated carboxylic acid or vinyl alcohol.

2. A photoreceptor according to claim 1 wherein said copolymer contains at least 40 wt% of ethylene units.

3. A photoreceptor according to claim 1 wherein said copolymer contains 1–50 wt% of vinyl acetate units.

4. A photoreceptor according to claim 1 wherein said subbing layer has a thickness not greater than 1 μm.

5. A photoreceptor according to claim 1 wherein said light-sensitive layer is composed of a carrier generation layer and a carrier transport layer.

* * * * *